US005123638A

United States Patent [19]

Mutou

[11] Patent Number: 5,123,638

[45] Date of Patent: Jun. 23, 1992

[54] DISPLACEMENT/DRIVING MEANS FOR DELIVERY FLY WHEEL UNITS

[75] Inventor: Minoru Mutou, Kanagawa, Japan

[73] Assignee: Kabushiki Kaisha Tokyo Kikai Seisakusho, Tokyo, Japan

[21] Appl. No.: 521,235

[22] Filed: May 9, 1990

[30] Foreign Application Priority Data

May 11, 1989 [JP] Japan ..... 1-116139

[51] Int. Cl.[5] ..... B65H 29/40

[52] U.S. Cl. ..... 271/187; 271/315; 271/81; 198/473.1; 198/478.1

[58] Field of Search ..... 271/178, 187, 314, 315, 271/81, 295; 198/458, 473.1, 478.1

[56] References Cited

U.S. PATENT DOCUMENTS

| | | | |
|---|---|---|---|
| 4,200,179 | 4/1980 | Hinz | 198/458 |
| 4,431,177 | 2/1984 | Beery et al. | 271/315 X |
| 4,635,920 | 1/1987 | Kodama | 271/81 |
| 4,790,061 | 12/1988 | Walker | 198/478.1 X |
| 4,865,307 | 9/1989 | Crofutt et al. | 271/187 |
| 4,895,361 | 1/1990 | Fujii et al. | 271/254 X |

FOREIGN PATENT DOCUMENTS

| | | | |
|---|---|---|---|
| 11570 | 1/1977 | Japan | 271/314 |
| 220753 | 11/1985 | Japan | 271/314 |
| 16982 | 1/1987 | Japan | 271/314 |

*Primary Examiner*—H. Grant Skaggs
*Assistant Examiner*—Boris Milef
*Attorney, Agent, or Firm*—Frost & Jacobs

[57] ABSTRACT

A delivery fly arrangement for use with a folder of a printing press comprising a plurality of delivery fly wheel units mounted on a horizontally extending fly shaft journalled in a pair of frames in such a manner that they may be displaced axially on and along the fly shaft and rotated as the fly shaft is rotated; a displacement/-driving system for displacing these delivery fly wheel units axially on and along the fly shaft, this displacement/driving system including a positional detector, a memory section, a control section, and an input-/output section; and connecting rods, plates and arms which allow the delivery fly wheel units to rotate with the rotation of the fly shaft and which operatively connect these delivery fly wheel units to the displacement/-driving system. Thus, the delivery fly arrangement is capable of sending out smoothly, regularly and accurately various kinds of folded printed product copies having different widthwise dimensions, which are delivered by the folder at the exit end of the printing press and received thereby, onto a delivery conveyor.

1 Claim, 4 Drawing Sheets

THE PRIOR ART

THE PRIOR ART

DISPLACEMENT/DRIVING MEANS FOR DELIVERY FLY WHEEL UNITS

BACKGROUND OF THE INVENTION

1. Field of the Invention

This invention relates to a delivery fly arrangement for use with a folder associated with a printing press, and more particularly to a fly wheel arrangement for use with a folder adapted to deliver plural kinds of folded paper or printed product copies having different widthwise dimensions.

2. Description of the Prior Art

Delivery fly wheel arrangements for receiving folded printed product copies delivered by a folder at the exit end of a printing press and delivering them onto a delivery conveyor are generally used and publicly known from U.S. Pat. No. 4,865,307, for example.

This publicly known delivery fly arrangement is constructed, as shown in FIGS. 1 and 2, such that a plurality of delivery fly wheel units 7 are fixedly secured by set screws 8 onto a fly shaft 6 journalled rotatably in frames FF installed on both sides thereof. In this delivery fly arrangements, as shown in FIG. 5, for example, folded printed product copies S conveyed by a transport conveyor C1 are received by delivery fly wheel units 71 in the delivery fly arrangement, while their widthwise dimensions are being subject to control by folded paper guides GA mounted on both sides of the delivery fly arrangement, and then delivered, as the delivery fly arrangement is rotated, from the arrangement by stoppers ST mounted between adjacent pairs of delivery fly wheel units 7 onto a delivery conveyor C2.

Whilst, with the diversification of printed matters, the widthwise dimensions of paper webs to be folded and delivered by the folder of the printing press have become diversified. Namely, printed matters having appreciably different dimensions have come to be handled by the folder. Therefore, in the delivery fly arrangement having delivery fly wheel units fixedly secured thereto, if the delivery fly wheel units are set at positions suitable for the receipt of folded printed product copies having the smallest width, then when handling folded paper having the largest width, both sides thereof will project appreciably from the delivery fly wheel units on both sides thereof and hang down. Therefore, when they are delivered onto a delivery conveyor, deviation in their orientations, bending of them, and uneven pitches between them on the conveyor belt will occur. To the contrary, if the delivery fly wheel units are set at positions suitable for the receipt of folded paper having the largest width, then it becomes impossible to set the folded paper guides at positions suitable for the receipt of folded paper having the smallest width, because of the interference of the delivery fly wheel units on both sides thereof. As a result, when folded printed product copies having the smallest width are received by the delivery fly arrangement, positional deviation between them occurs, and in the worst case, one side of the folded printed product copies having the smallest width will slip off and hang down from the lateral delivery fly wheels units of the delivery fly arrangement, and when they are delivered onto the delivery conveyor, deviation or discrepancy in their orientations, bending of them or uneven pitches between them on the conveyor belt will take place.

Therefore, to cope with such difficulties, each time change in the widthwise dimension of folded printed product copies to be handled thereby occurs, it has so far been required for the operator to loosen the set screws, displace the delivery fly wheel units along the fly shaft to proper positions, and fixedly secure them by the set screws again.

SUMMARY OF THE INVENTION

The present invention has been made in view of the above-mentioned circumstances in the prior art, and has for its object to provide a delivery fly arrangement for use with a folder at the exit end of a printing press wherein delivery fly wheel units forming the delivery fly arrangement can be displaced automatically or manually and very easily axially along a fly shaft of the arrangement, regardless of whether the printing press is in operation or stopped, so that various kinds of folded printed product copies may be delivered smoothly regularly and accurately onto a delivery conveyor.

To achieve the above-mentioned objects, according to a first aspect of the present invention, there is provided a delivery fly arrangement for use with a folder of a printing press comprising: a plurality of delivery fly wheel units mounted on a fly shaft in such a manner that they may be displaced axially on and along the fly shaft and rotated as the latter is rotated; a displacement/driving means for displacing these delivery fly wheel units axially on and along the fly shaft; and connecting means which allow the delivery fly wheel units to rotate with the rotation of the fly shaft and which operatively connect these delivery fly wheel units to the driving means.

According to a second aspect of the present invention, there is provided a delivery fly arrangement as set forth in the first aspect, characterized in that the displacement/driving means comprises: positional detector means for detecting the axial position of each of the delivery fly wheel units along the fly shaft; a memory section for storing data on the axial positions of the delivery fly wheel units to be displaced on and along the fly shaft, which is preset so as to correspond to appropriate data on printing, so that the data may be compared with the data detected by the detecting section; a control section for reading out the data on displaced positions of the delivery fly wheel units from the memory section, and comparing the thus read-out data with the data detected by the detecting section, and then controlling the operation of the driving means so as to eliminate the difference therebetween; and an input and output section for inputting data on printed product copies folded and delivered by the folder to the control section and outputting the data on displaced positions of the delivery fly wheel units which are read out by the control section from the memory section on the basis of the input data, and the data detected by the detecting section.

The above-mentioned and other objects, aspects and advantages of the present invention will become apparent to those skilled in the art by making reference to the following detailed description and the accompanying drawings in which a preferred embodiment incorporating the principles of the present invention is shown by way of example.

DETAILED DESCRIPTION OF PREFERRED EMBODIMENTS

A preferred embodiment of the present invention will be described below by way of example with reference to the accompanying drawings.

Figure 1:
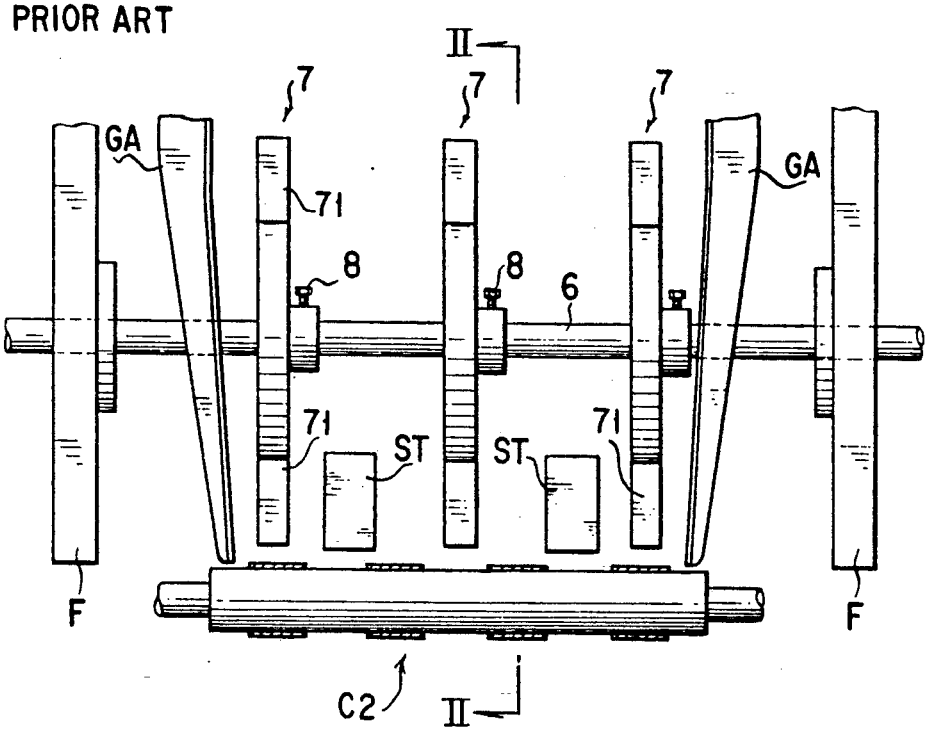
FIG. 1 is a schematic, front view showing one embodiment of the prior art delivery fly arrangement.
Figure 2:
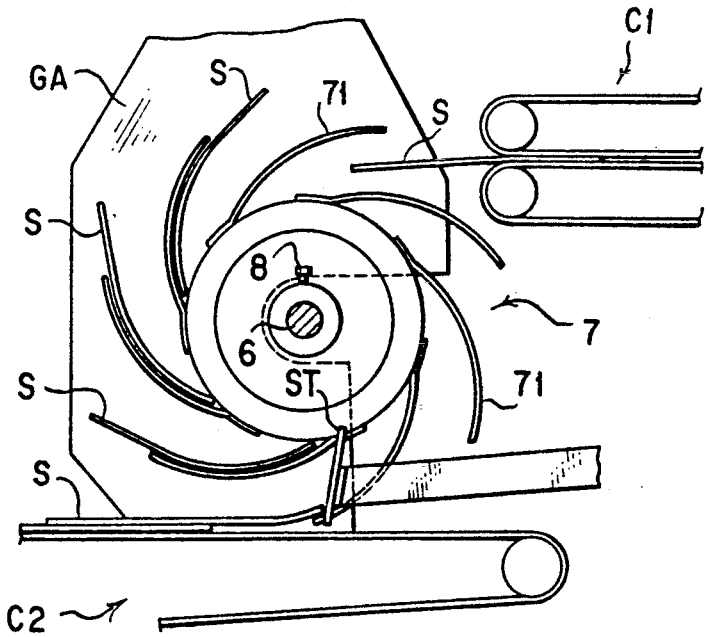
FIG. 2 is a side elevational view of the delivery fly arrangement showing partial vertical section taken along line II—II in FIG. 1.
Figure 3:
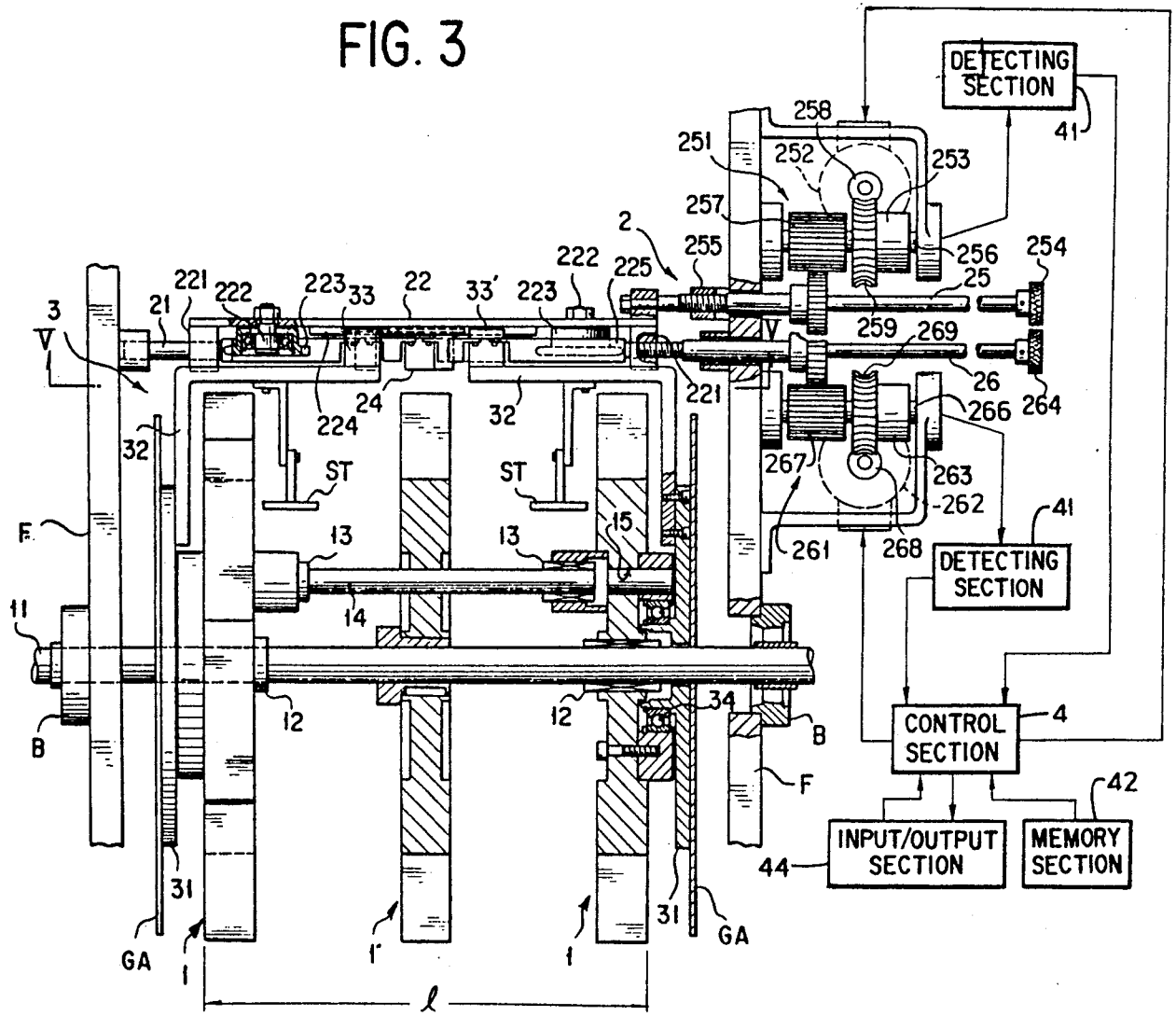
FIG. 3 is a plan view showing one embodiment of the delivery fly arrangement according to the present invention showing the partial horizontal section.
Figure 4:
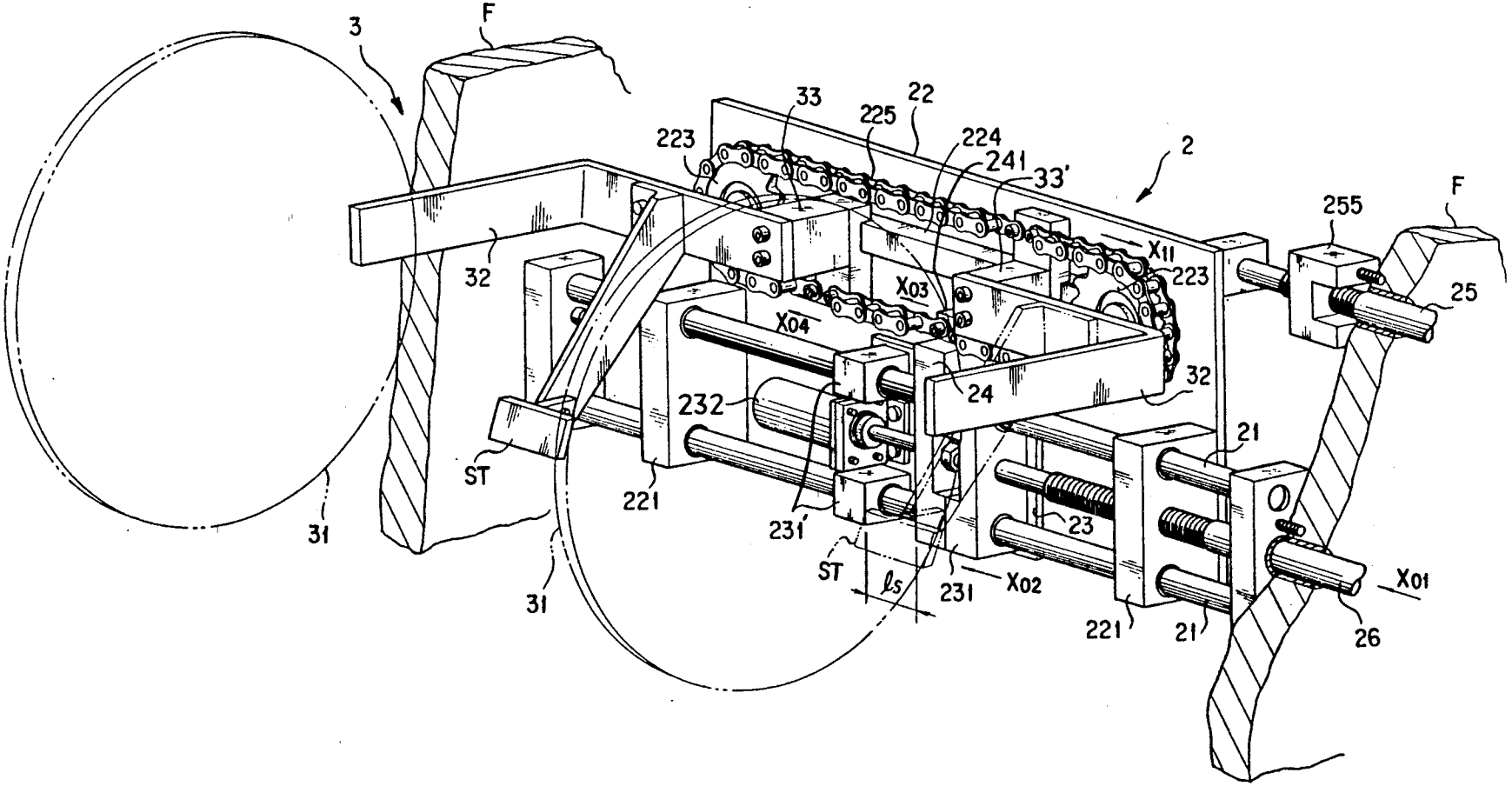
FIG. 4 is a perspective view showing principal parts of displacement and driving means and connector means in the embodiment shown in FIG. 3.
Figure 5:
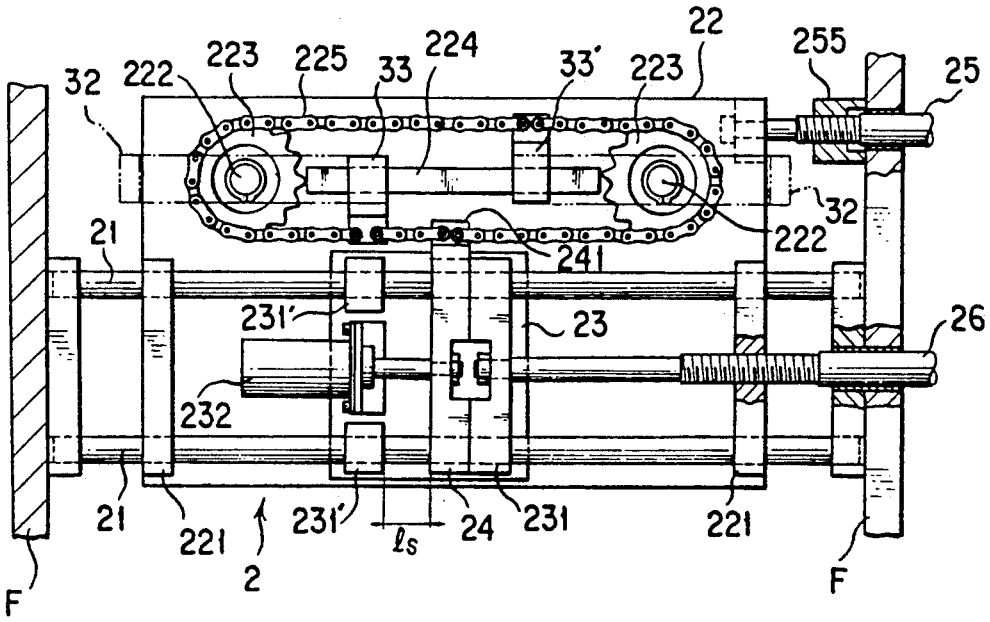
FIG. 5 is a view looking along line V—V in FIG. 3 showing the partial vertical section of the delivery fly arrangement.

Referring to FIGS. 3 to 5, there is shown a rotating shaft or fly shaft 11 which is rotatably journalled through bearings B, B mounted in frames F, F, and which has a stationary delivery fly wheel unit 1' fixedly secured to the approximately axially central part thereof, and axially slidable delivery fly wheel units 1, 1 journalled through sliding bearings 12, 12 on both sides of the shaft 11 so that they may be freely shifted therealong. The axially slidably movable delivery fly wheel units 1, 1 are arranged so that they may be rotated in synchronism with the stationary delivery fly wheel unit 1' and in the same direction as the latter through sliding bearings 13, 13 and a connecting rod 14.

Therefore, the delivery fly wheel units 1, 1, and 1' are simultaneously rotated in the same direction with rotation of the fly shaft 11. Further, the axially slidable delivery fly wheel units 1, 1 are rotatably connected through bearings 34 with connecting plates 31, respectively. The connecting plates 31, 31 are fixedly secured to the other ends of connecting arms 32, 32 whose one ends are fixedly secured to block members 33 and 33', respectively. The block members 33 and 33' are connected to a displacement/driving means 2 which will be described hereinbelow.

The displacement/driving means 2 is configured as follows.

Mounted between the frames F, F having the transversely extending fly shaft 11 rotatively carried thereby and in parallel with the shaft 11 are two left and right vertically spaced apart guide shafts 21 and 21. Further, both the guide shafts 21, 21 have sliding members 221, 221 mounted slidably thereon and having a first base plate 2 fixedly secured thereto so as to enable the first base plate 22 to be slidably moved along the shafts 21, 21 through the intermediary of the sliding members 221, 221, and also have sliding members 231, 231' and 231' (see FIGS. 4 and 5) mounted slidably thereon and having a second base plate 23 fixedly secured thereto so as to enable sliding movement of the second base plate 23 along the shafts 21, 21 through the intermediary of the sliding members 231, 231' and 231'. Moreover, a sliding member connected to the leading end of an extensible and retractable rod of a piston within a hydraulic cylinder 232 fixedly secured to the second base plate 23 is slidably mounted on the guide shafts 21, 21. The first base plate 22 has two stub shafts 222, 222 mounted thereon in such a manner that a plane including the respective axis of the stub shafts is in parallel relationship with the axis of the fly shaft 11. The stub shafts 222, 222 are provided with sprocket wheels 223, 223, respectively. A guide member 224 for guiding the above-mentioned block members 33, 33' is fixedly secured to the first base plate 22 between the stub shafts 222, 222. Further, an endless chain 225 is wound round the sprocket wheels 223, 223, respectively. The endless chain 225 is connected to the block members 33, 33, such that either one of the block members 33, 33' is fixedly secured to a horizontal portion of the loop of the chain 225 wound round the sprocket wheels 223, 223 on one side, whilst the other one is fixedly secured to a horizontal portion of the chain loop on the other side. Accordingly, as the endless chain 225 is moved round and between the sprocket wheels 223, 223, the block members 33 and 33' are displaced in opposite directions with each other. Further, the first base plate 22 has a sliding member 221' fixedly secured on the upper, right hand side (as viewed in FIG. 4) of the rear surface thereof. One end of a first displacement/driving shaft 25 having a male screw-threaded portion formed on the intermediate portion thereof and adapted to be threadably engaged with a female screw-threaded portion formed in a female screw block 255 is rotatably connected with the sliding member 21'. The other end of the first displacement/driving shaft 25 is projected outside the frame F so as to allow the shaft to be slidably moved freely relative to the frame F, and is connected through the intermediary of a gear train 251 to a driver means 252 such that as occasion calls the gear train 251 can be connected or disconnected from the driver means 252 by means of a clutch 253. The shaft 25 has a manual handle 254 fixedly secured to the other extreme end thereof.

Still further, one end of a second displacement/driving shaft 26 having a male screw-threaded portion formed on the intermediate portion thereof and adapted to be threadably engaged with a female screw-threaded portion formed in one of the sliding members 221 is rotatably connected through the sliding member 231 to the second base plate 23. The other end of the second displacement/driving shaft 26 is projected outside the frame F so as to allow the shaft 26 to be slidably moved freely relative to the frame F, and is connected through a gear train 261 to a driver means 262 such that as and when required the gear train 261 can be connected or disconnected from the driver means 262 by means of a clutch 263. The shaft 26 has a manual handle 264 fixedly to the right hand end thereof as viewed in FIG. 3.

Whilst, a control section 4 is provided to automatically control the operation of the displacement/driving device 2.

The control section 4 comprises detecting sections 41, 41 for detecting the axial position of each of the slidable delivery fly wheel units 1, 1 along the fly shaft 11; a memory section 42 for storing data on the axial positions of the delivery fly wheel units 1, 1 to be displaced on and along the fly shaft 11, which is preset so as to correspond to appropriate data on folded paper, such as, for example, data on the widthwise dimension of folded paper delivered by the folder or combination of data on the dimension of the paper webs to be folded and delivered and how to fold them so that the above data on displaced position of the delivery fly wheel units 1, 1; may be compared with the data detected by the detecting sections 41, 41; a control section 4 for reading out from the memory section 42 the data on displaced positions of the delivery fly wheel units corresponding to appropriate data on the folded paper input by an input/output section 44 which will be described later, and comparing the thus read-out data on displaced positions of the delivery fly wheel units with the data detected by the detecting sections 41, 41, and then controlling the operation of the driver means 252 and 262 so as to eliminate the difference between them; and the input/output section 44 for inputting appropriate data on folded paper to the control section 4 and outputting the data on displaced positions of the units 1, 1 which are read out by the control section 4 from the memory section 42 on the basis of the input data and also the data detected by the detecting sections. 41, 41. In the embodiment shown in FIG. 3, the rotation of the first and second displacement/driving shafts 256 and 266, respectively, is detected by the rotation of idle shafts 256 and 266, respectively, and the displaced position of the axially, slidable delivery fly wheel units 1, 1 is detected using the pitches of the male screw threaded portions of the first displacement/driving shaft 25 and the second displacement/driving shaft 26, respectively, as coefficients for detection purposes. While, in FIG. 3, rotation detecting sections of the idle shafts 256, 266 are shown by lines 41, 41 for abbreviation purposes, a proper configuration wherein (not shown) including the gears 257 and 267, respectively, may be used.

Further, in FIGS. 3 and 4, reference characters GA, GA denote folded paper guides attached to the connecting plates 31, respectively so as to control the widthwise position of folded paper to be delivered, whilst reference numerals ST indicate stoppers projecting between the delivery fly wheel units 1 and 1' and attached to the connecting arms 32, respectively, so as to deliver the folded paper received from the delivery fly wheel units 1, 1' downstream of them with the rotation thereof.

Further, connected to the hydraulic cylinder 232 fixedly secured to the second base plate 23 are pipings which are connected through a change-over valve, not shown, to a pressurized fluid supply source (not shown) for the purpose of supplying and discharging fluid for actuating the piston rod within the cylinder 232. In the embodiment shown, there is provided an arrangement (not shown) wherein when the operating speed of the printing press has reached a predetermined value, the change-over valve changes over the supply and discharge of fluid for actuating the piston rod into and from the hydraulic retractible rod.

The operation of the above-mentioned arrangement is as follows.

First of all, appropriate data on folded paper delivered by the operation of a printing press, for example, data on combination of the dimension of paper webs to be folded and how to fold them are input by the input-/output section 44 of the control section into the control section 44. Thereupon, the control section 43 will read out data on the displaced position of the slidable delivery fly wheel units 1, 1 corresponding to the input data from the memory section 42, and output or transmit the above-mentioned data together with the data detected by the detecting sections 41, 41 to the input output section 44, and also compare the data on the displaced position of the units 1, 1 thus read out with the detected data so that if there is a difference between these data until it is eliminated the driver means 252 or/and the driver means 262 is/are actuated, and hence, the displacement/driving means 2 is actuated to thereby allow displacement of the slidable delivery fly wheel units 1, 1 to a predetermined position along the fly shaft 11.

The operation of the displacement/driving means 2 is as follows.

As the output shaft of the driver means 252 is rotated, the first displacement/driving means 25 is rotated through the gear train 251. Since the intermediate male screw-threaded portion of the first displacement/driving shaft 25 is threadably engaged with the female threaded portion in the female screw block 255 fixedly secured to the frame F, the shaft 25 is displaced to the left or to the right in FIG. 3 relative to the frame F when it is rotated thereby causing displacement of the first base plate 22, to which one end of the shafts 21, 21. Since the intermediate male screw-threaded portion of the second displacement/driving shaft 26 is threadably engaged with the female screw-threaded portion in the sliding member 221 fixedly secured to the first base plate 22, the shaft 26 is displaced correspondingly in response to the displacement of the first base plate 22 without its positional relationship with the latter so that the second base plate 23, to which one end of the shaft 26 is connected, will also be displaced in response to the displacement of the first base plate 22 without changing its positional relationship with the latter. At that time, the mechanisms associated with the first and second base plates 22 and 23 are displaced simultaneously by the operation of the driver means 252 by the same amount in the same direction, thus causing displacement of the two axially slidable delivery fly wheel units 1, 1 along the rotating shaft without changing the spacing l therebetween through the intermediary of the chain wheels 223, 223, the chain 225, the block members 33, 33', the connecting arms 32, 32, the connecting plates 31, 31 and the bearings 34, 34.

When the output shaft of the driver means 262 is rotated, the second displacement/driving shaft 26 is rotated through the gear train 261. Since the intermediate male screw-threaded portion of the second displacement/driving shaft 26 is threadably engaged with the female screw threaded portion in the sliding member 221 fixedly secured to the first base plate 22, and also since the first base plate 22 is in fixed relationship with the frame F because the male screw-threaded portion of the first displacement/driving shaft 25 is meshed with the female screw-threaded portion in the female screw block 255, the second displacement/driving shaft 26 is displaced to the left or to the right relative to the first base plate 22 when it is rotated, thus causing displacement of the second base plate 23 along the guide shafts 21, 21 through the intermediary of the sliding member 231 to which one end of the shaft 26 is connected. At that time, simultaneous displacement of the mechanism associated with the second base plate 23, that is to say; the hydraulic cylinder 232 and the sliding member 24 connected to the leading end of the extensible and retractible piston rod therein will occur, which results in displacement of the endless chain 225 to which the sliding member 24 is connected and which is wound round and between the sprocket wheels 223, 223. This displacement of endless D chain 225 causes displacement of the block members 33, 33' connected thereto in opposite directions with each other.

Stating this operation more concretely with reference to FIG. 4, displacement of the second displacement/-driving driving shaft 26 in the direction shown by arrow $X_{01}$ brings about displacement of the second base plate 23 and the mechanism associated therewith in the direction shown by arrow $X_{02}$ through the intermediary of the sliding member 231 to which one end of the shaft 26 is connected, which results in displacement of an endless chain connecting portion 241 of the sliding member 24 in the direction shown by arrow $X_{03}$. As a result, the horizontal portion (lower portion as viewed in FIG. 4) of the loop of the endless chain 225 wound round the sprocket wheels 223, 223 is shifted in the direction shown by arrow $X_{04}$, whilst the horizontal portion (upper portion) of the loop on the other side is displaced in the direction shown by arrow $X_{11}$, thus causing displacement of the block members 33 and 33', respectively, in accordance with the displacement of the lower and upper horizontal portions, respectively, of the chain 225.

This displacement of the block members 33 and 33' causes displacement of the two axially slidable delivery fly wheel units 1, 1 along the fly shaft 11 through the intermediary of the connecting arms 32, the connecting plates 31 and the bearings 34 so as to change the spacing "l" therebetween.

In both the above-mentioned cases, locking of the first displacement/driving shaft 25 or the second displacement/driving shaft 26 is achieved by meshing worm gear 258 or 268 in the gear train 251 or 261 with worm wheel 259 or 269.

Further, the first and second displacement/driving shafts 25 and 26 can be manually operated by means of the handles 254 and 264, respectively, after disconnecting the worm wheels 259 and 269 from the idle shafts 256 and 266, respectively, by means of the clutches 253 and 263, respectively.

Whilst, extension and retraction of the rod of the piston within the hydraulic cylinder 232 fixedly secured to the second base plate 23 will cause displacement of the sliding member 24, to which the leading end of the rod is connected, along the guide shafts 21, 21 relative to the second base plate 23 and the first base plate 22, respectively. Such displacement of the sliding member 24 brings about displacement of the endless chain 225 as in the aforementioned case with the result that the two slidable delivery fly wheel units 1, 1 are displaced along the rotating shaft 11 in opposite directions so as to change the spacing therebetween by an amount corresponding to the length of stroke of the rod of the piston within the hydraulic cylinder 232. When the sliding members 231 and 231' fixedly secured to the second base plate 23 serves as stoppers against the displacement of the sliding member 24 caused by extension and retraction of the rod, the length of the above-mentioned stroke is "ls".

It will be apparent from the above-mentioned construction that in each of the above-mentioned displacement the stoppers ST attached to the connecting arms 32, respectively, and the folded paper guides GA attached to the connecting plates, respectively, are located at predetermined space intervals from the axially slidable delivery fly wheel units 1, 1 and do not impede the displacement of the latter.

Further, the connecting rod 14 connecting the axially slidable delivery fly wheel units 1, 1 to the stationary delivery fly wheel unit 1' has end portions projecting from the sliding bearings 13 to the slidable delivery fly wheel units 1, 1', each of which is accommodated in a hole 15 formed in each of the units 1, 1', when each of the above-mentioned displacement operations occur. (the hole formed in one of the delivery fly wheel units 1, 1 is not shown).

As described hereinabove, after the slidable delivery fly wheel units 1, 1 are displaced to an optimum position to receive delivered by the operation of the printing press, the press is put into operation. Thereupon, the rotating shaft 11 of the delivery fly assembly is rotatively driven by a drive system, not shown, so that the slidable delivery fly wheel unit 1, 1 are rotated simultaneously through the stationary delivery fly wheel unit 1' fixedly secured to the rotating shaft 11, the connecting rod 14 and the sliding bearings 13, so as to receive folded paper.

However, when the printing press is rotated at a low speed immediately after the starting thereof, the dimensions of folded printed product copies delivered by the folder at the exit end of the press tends to become irregular, and therefore in the condition that the folded paper guides GA, GA are set at their normal positions there are cases where the delivery fly wheel assembly becomes unable to receive folded paper. To cope with this, extension and retraction of the rod of the piston with the operating speed of the printing press. Stating more particularly, in the embodiment shown in FIG. 4, when the operating speed of the printing press is less than a predetermined value, the extensible and retractible rod of the piston within the hydraulic cylinder 232 is retracted so as to make the spacing between the folded fly wheel units 1, 1 wider than their respective normal values. When the operating speed of the printing press exceeds the predetermined value, the changeover valve will be changed over so as to simultaneously restore the spacing between the folded paper guides GA, GA and that between the slidable delivery fly wheel units 1, 1 to their respective normal values. By so doing, the receipt and delivery of folded printed product copies delivered by the folder at the exit end of the printing press in the period from the starting thereof to the stopping can be performed smoothly.

While the present invention has been particularly shown and described with reference to a preferred embodiment thereof, it will be understood by those skilled in the art that the present invention is not to be limited thereto and various changes and modification can be made without departing from the spirit or scope of the following claims.

What is claimed is:

1. A delivery fly arrangement for use with a folder of a printing press comprising: a plurality of delivery fly wheel units mounted on a fly shaft in such a manner they may be displaced axially on and along the fly shaft and rotated as the latter is rotated; a displacement/driving means for displacing these delivery fly wheel units axially on and along the fly shaft, said displacement/driving means comprising positional detector means for detecting the axial position of each of the delivery fly wheel units displaced along said fly shaft, a memory section for storing data on the axial positions of said delivery fly wheel units displaced along said fly shaft, a memory section for storing data on the axial positions of said delivery fly wheel units to be displaced on and along said fly shaft, which is preset so as to correspond to appropriate data on printing, so that said data may be compared with the data detected by said positional detector means, a control section for reading out the data on displaced positions of the delivery fly wheel units from said memory section, and comparing the thus read-out data with the data detected by said positional detector means, and then controlling the operation of said displacement/driving means so as to eliminate the difference therebetween, and an input/output section for inputting predetermined data on printed product folded and delivered by the folder to the control section and outputting the data on displaced positions of the delivery fly wheel units which are read out by said control section from said memory section on the basis of the input data, and the data detected by said positional detector means; and connecting means which allow said delivery fly wheel units to rotate with the rotation of the fly shaft and which operatively connect these delivery fly wheel units to said displacement/driving means.

* * * * *